US005346391A

United States Patent [19]

Fullemann et al.

[11] Patent Number: 5,346,391

[45] Date of Patent: Sep. 13, 1994

[54] CLEAN BURNING BURNER, PARTICULARLY FOR COMBUSTION OF GASIFIED LIQUID FUEL, SUCH AS FUEL OIL, OR OF GAS

[75] Inventors: Jörg Fullemann, Mastrils; Heinrich Boner, Malaus, both of Switzerland

[73] Assignee: Füllemann Patent AG, Mastrils, Switzerland

[21] Appl. No.: 22,721

[22] Filed: Feb. 24, 1993

[30] Foreign Application Priority Data

Feb. 28, 1992 [CH] Switzerland ..... 636/92-0

[51] Int. Cl.[5] ..... F23D 7/00

[52] U.S. Cl. ..... 431/116; 431/208

[58] Field of Search ..... 431/115, 116

[56] References Cited

U.S. PATENT DOCUMENTS

| | | | |
|---|---|---|---|
| 2,867,270 | 1/1959 | Brzozowski | 431/116 |
| 4,624,631 | 11/1986 | Kobayashi et al. . | |
| 4,629,414 | 12/1986 | Buschulte et al. | 431/116 |
| 4,957,427 | 9/1990 | Fullemann et al. . | |
| 5,015,173 | 5/1991 | Fullemann et al. . | |
| 5,154,597 | 10/1992 | Fullemann et al. . | |

FOREIGN PATENT DOCUMENTS

| | | |
|---|---|---|
| 1951752 | 6/1971 | Fed. Rep. of Germany . |
| 2553953 | 5/1977 | Fed. Rep. of Germany . |
| 2833686 | 3/1980 | Fed. Rep. of Germany . |

*Primary Examiner*—Carroll B. Dority

*Attorney, Agent, or Firm*—Frishauf, Holtz, Goodman & Woodward

[57] ABSTRACT

To provide gasification of liquid fuel which is admitted by an atomizing nozzle (11, 13) into a gasification space (66). A deflection element (31) is located spaced from an air inlet (55) in order to deflect the mixture of air, recirculated combustion gases and gasified fuel in the gasification space. A flame tube (21) provides for a first (I) recirculation path for hot gases towards a recirculation openings (49). A second recirculation path (II) extends through openings (57, 61, 59) into the deflection element itself which, preferably, is a hollow, essentially shallow conical deflection structure. The deflection element in combination with the flame tube (21) causes recirculation of gases through the first recirculation path (I) back into the gasification space (66). Thus, all structural elements of the gasification space are subjected to recirculated hot combustion gases, so that no droplets from the atomizing burner (13) can adhere, and coke on structural elements. The efficient recirculation together with the complex stream relationships, caused by the braking effect of the recirculation element, and eddies and turbulences arising from over-pressure air supplied by the air inlet (55), result in effectively complete gasification of fuels within the gasification space (66) the end of the flame tube burns blue, with practically no $NO_x$ even if no real gasifier structure is present. The flame, expanding in radial direction due to the deflection element, near formation, and effectively devoid of unburned hydrocarbons.

25 Claims, 6 Drawing Sheets

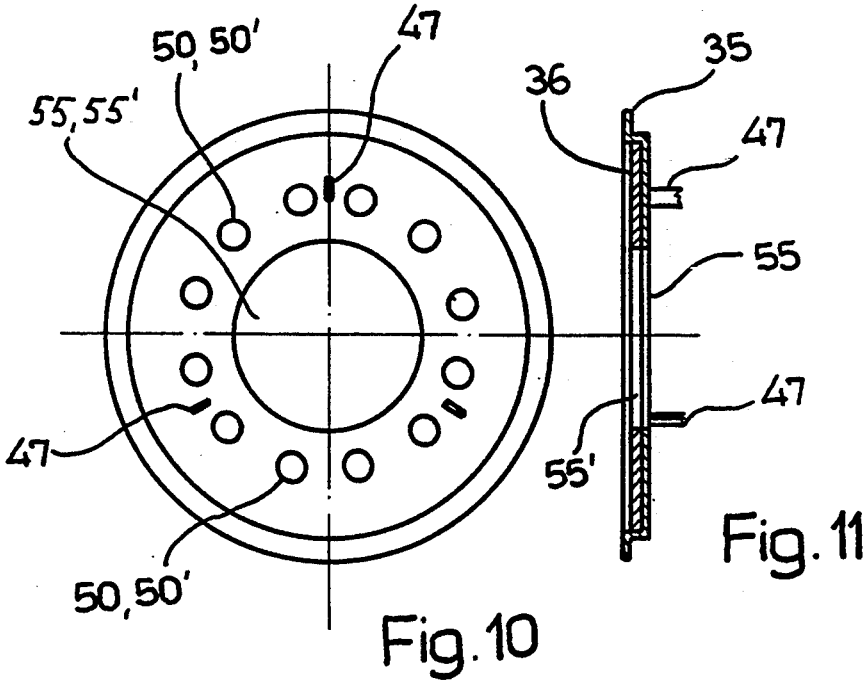
Fig. 10
Fig. 11
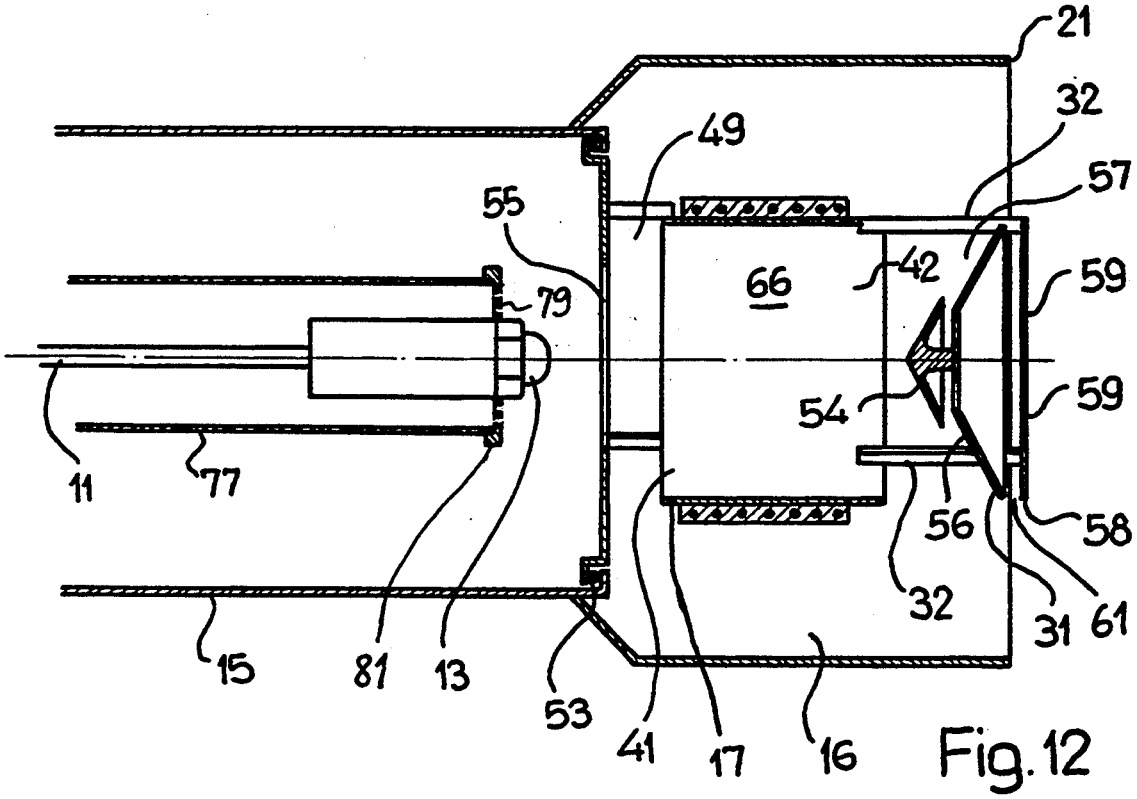
Fig. 12

CLEAN BURNING BURNER, PARTICULARLY FOR COMBUSTION OF GASIFIED LIQUID FUEL, SUCH AS FUEL OIL, OR OF GAS

Reference to related patents, the disclosures of which are hereby incorporated by reference, by the inventors hereof:

U.S. Pat. No. 4,957,427, Füllemann et al
U.S. Pat. No. 5,015,173, Füllemann et al
U.S. Pat. No. 5,154,597, Füllemann et al
U.S. Pat. No. 4,624,631, Kobayashi et al.
Reference to related disclosures:
German 19 51 752, Brödlin
German 25 53 953, Kopp
German 28 33 686, Kopp.

FIELD OF THE INVENTION

The present invention relates to burners, and particularly, but not exclusively, to industrial or home furnace burners having outputs in the 7 kilowatt–20,000 kilowatt range, suitable for burning liquid fuels, such as fuel oil, by gasifying the fuel, although the burner can also be used for burning of gas, for example natural gas.

BACKGROUND

Burners of the type to which the present invention relates usually have a gasifier to which fuel can be supplied, for example via an atomizing nozzle, an air inlet, and, at the outlet, a distribution device. The distribution device may have a plurality of openings therein.

German Patent 19 51 752, Brödlin, describes a burner having a mixture distribution body located spaced from a fuel nozzle. The mixture distribution body is intended to finely divide liquid fuel, which is not yet mixed with combustion air, at its surface, so that a larger surface is available for impingement by the combustion air than of the fuel itself. Additionally, the mixture distribution body is intended to form a stabilizer for the flame which will result. It is noted in the publication that prior mixture distribution bodies could not obtain complete gasification, so that the flame will burn with a blue flame color, that is, without smoking or formation of soot.

Blue flames can be obtained with recirculation burners; burners of such types, however, are very expensive and useful for central heating plants only under limited conditions since the combustion chambers of such plants vary widely and uniform operation of all burners could not be assured.

The mixture distribution body described in the referenced German Patent 19 51 754, Brödlin, was stated to have a diameter of 45 mm, and formed with openings or bores, spaced center-to-center by 12 mm, of clear openings of 8 mm. These openings were distributed over the entire surface of the body. The air stream, insofar as it does not impinge on the body structure, passes through these openings.

The openings were intended to conduct heat derived from the flame which occurs at the body to the forward part of the mixture distribution body on which the partially gasified oil-air mixture impinges. The material of the mixture distribution body, remaining between the bores, was of sufficient size to ensure a generally uniform heat distribution or, respectively, an essentially uniform heat flow.

It has been found in actual practice that the burner structure as proposed did not fulfill the expectations. As described in German Patent 28 33 686, Kopp, instabilities and deposits of coke arise upon starting and during warm-up of the burner. Such instabilities and coke deposits result in high noise levels in operation and, further, in noxious exhaust gases.

German Patent 25 53 953, Kopp, assigned to the same assignee as the first-mentioned German Patent 19 51 752, Brödlin, proposes a switch-over device which can be so changed that, during starting and warm-up operation, combustion air is made turbulent in the region of the atomizing nozzle. Upon starting and warming up, this burner, then, operates with a yellow flame. After the burner has warmed up, the switch-over device is operated, so that, after heating of the distribution body, and continuous operation, combustion air is supplied in essentially laminar flow, without turbulence.

It has been found that this solution has the disadvantage of increased technical requirements and controls, and the danger always arose that the transfer mechanism did not operate properly. The turbulent yellow flame is noisy, and coking problems still arose. Additionally, the burner cannot meet current clean-air requirements.

The burner of the German Patent 28 33 686, Kopp, uses a mixture distribution body in combination with a switch-over device. Combustion air is applied, during starting and the warm-up phase, in form of a tubular hollow jet to the mixture distribution body without turbulence, however. Upon switch-over, that is, in continuous operation, the combustion air is provided in form of a beamed, tightly cohesive or bundled jet to the interior region of the mixture distribution body. This burner, also, is subject to malfunction if the switch-over device does not operate properly.

Two types of mixture distribution bodies have been proposed. One such body is essentially hemispherical; this element operates, in continuous steady-state operation, approximately similarly to the body shown in the aforementioned German Patent 19 51 752, Brödlin, which, however, did not find commercial acceptance for continuous operation due to the high coking deposits formed in operation. In another embodiment, the mixture distribution body has a plurality of axially staggered frusto-conical rings. The inner diameter of subsequent rings—in flow direction of the air—is smaller, or equal to the outer diameter of the immediately preceding ring. At the forward end, a cover with preferably six openings is provided.

In continuous operation, a concentrated beam or jet of air is applied tangentially to the mixture distribution body to surround it, and to induce in the circular slits between the rings back-flow or back-streams of hot combustion gases which flow through the fuel which slips off the rings, for gasing the fuel. A comparatively small portion of the fuel which impinges on the mixture distribution body flows, together with combustion air, through the openings in the cover and into the interior of the mixture distribution body, so that small yellow flames will result. The proportion of combustion air there available is small, so that these small flames which burn yellow are smoky and cause soot. They are needed, however, since they stabilize the overall combustion. It is believed that the stabilizing effect is due to heating of the mixture distribution body so that it can effectively hold the flame.

It has been found, in operation, that combustion with this burner results in excessively high nitrogen-oxyide ($NO_x$) emission; carbon monoxide emission also is high, and the overall exhaust gases do not meet clean-air requirements.

The stream of air which surrounds, in part, the mixture distribution body has the effect of sucking combustion gases out of the combustion chamber. They stream along the mixture distribution body and cause heating of its surface In dependence of the dimensioning of the combustion chamber, the combustion gases fed back are more or less hot, so that sufficient vaporization heat is not necessarily available in all cases. This type of recirculation does not cause intensive mixing with the fuel. Reliable operation of the burner, thus, is not ensured and had led to the comments in the aforementioned literature that the recirculation burner has disadvantages.

The burner in accordance with the German Patent 28 33 686, Kopp, generates a relatively high proportion of thermal $NO_x$. Due to the Coanda effect (the wall attachment phenomenon of fluid jets), the stream of the air-fuel mixture follows along the outer wall of the mixture distribution body. This outer wall, at the end, is parallel to or at an acute angle with respect to its axis, so that the air leaves in essentially axial direction. This is a very hot flame which constricts towards its axis, a flame which inherently enhances the formation of $NO_x$ gases.

U.S. Pat. No. 4,624,631, Kobayashi et al, describes a kerosene burner in which a hollow conical or hemispherical burner cup of porous ceramic material is located within a porous ceramic burner chamber. This is a kerosene burner, and the problems which were discussed in connection with the German Patent 28 33 686, Kopp, arise similarly in this structure.

All the burners described heretofore have in common that liquid fuel, for example oil drops, impinge on a body. This body may be termed a mixture distribution body, a burner cup or the like. This body is heated by recirculation by the flames which arise at the holes in the body. In the burner of the German Patent 23 33 686, Kopp, the fuel drops impinge on the conical rings, and it is intended that the fuel which drops or slips off the rings is gasified by the recirculation of hot combustion gases. In all the burners described heretofore gasification and mixing of fuel with air are not clean, or clearly defined processes both with respect to time as well as with respect to location. The mixture of gasified fuel and air thus is not homogeneous. It has been found that after extended operation of the burner, the geometry of the stream emitted from the nozzle will change, so that the spray cone emitted therefrom becomes irregular. Consequently, the mixture distribution body, or the combustion cup, respectively, will no longer be uniformly heated by the flames arising therebeyond. This non-uniformity, again, interferes with vaporization of the fuel, with the result that the generation of carbon monoxide increases; unburned hydrocarbon components have even been found in the exhaust gases. An additional factor is an increase in noise level in operation of the burner.

The yellow, smoking flames which arise within the cavity of the mixture distribution body, or in a combustion cup, are necessary in order to provide the necessary heat for vaporization of the fuel. Sometimes these flames may be blue. These flames generate very high temperatures within the cavity which, again, leads to excessive production of $NO_x$ gases in operation of such burners.

The referenced U.S. patents by the inventors hereof describe a recirculation burner in which, downstream from the fuel nozzle, a gasification space is first located followed by a mixing head, and then a deflection arrangement. In contrast to the previously described burners with mixture distribution bodies, which do not effect a continuous change in direction of the flame, the burners of the referenced patents by the inventors hereof are constructed to provide for deflection of the flame in essentially radial direction. Thus, and in contrast to the arrangement of the German Patent 19 51 752, Brödlin, the burners of the referenced U.S. Pat. No. 4,957,427, Füllemann et al, U.S. Pat. No. 5,015,173, Füllemann et al, U.S. Pat. No. 5,154,597, Füllemann et al, cause vaporization of the fuel and mixing of the vaporized fuel with air in separate steps. The German Patent 19 51 752, Brödlin, was intended to replace the previously expensive recirculation burners with the simple mixture distribution element. In accordance with the referenced patents by the inventors hereof, vaporization of the fuel is effected first by a gasifier which is heated by hot recirculation gases. Thereafter, the now gasified fuel is mixed with air. This mixture then can leave the mixing head by a plurality of slit-formed exit openings. Gasifier and mixing head are surrounded by a flame tube which extends about to the end of the deflection arrangement, and which also causes formation of a recirculation path to the gasifier space. This deflection arrangement, in contrast to the prior art, does not function as the gasifier itself; it is not heated, and, looking at it first, one cannot see why or if it should be heated.

THE INVENTION

It is an object to improve burners which are even cleaner burning than the burners described and patented in the aforementioned U.S. patents by the inventors hereof, to further reduce thermal $NO_x$ components in the exhaust gases, and the operation of the burner should be essentially independent of the configuration of the combustion space of a boiler, for example, in which the burner is to be used.

Briefly, the general structure of the burner has the features of the burners described in the patents by the inventors hereof, U.S. Pat. Nos. 4,957,427, 5,015,173 and 5,154,597, that is, the burner has a hollow structure with an inlet, an outlet, fuel supply means to direct fuel into the air inlet and into the into the structure, a flame tube leaving a gas recirculation space between the flame tube and the structure body, and a gas-air mixture deflection element positioned to direct a flame towards the flame tube, in essentially radial direction.

In accordance with the present invention, the deflection element which is provided is so shaped and configured that a second air recirculation or deflection path is formed for hot combustion gases to guide them back into a gasification space, for additionally contributing to gasification and and, importantly, for heating the deflection element.

The construction provides for heating all the elements which define the gasification chamber or gasification space, that is, for example, a tube which surrounds the gasification space and which, for starting, can be electrically heated, if desired, as well as the deflection element from which the gasified fuel-air mixture is deflected for forming an essentially radially directed flame. By heating the deflection plate as well, and recirculating combustion gases to the region of the deflection plate, adhesion of any droplets of fuel at that point is effectively avoided, and thus coking of fuel at that point is eliminated.

The actual events within the gasification chamber are complex. The braking effect of the deflection device, recirculation of hot gases at both ends, in opposite direction, of the gasification chamber, and turbulence arising from air supplied under pressure by the usual air inlet opening results, effectively, in essentially complete gasification of all fuels within the gasification space—although actually a real carburetor or gasifier is not provided. The flame which will result is highly radially expanding, and blue, with very $NO_x$ formation and practically devoid of unburned hydrocarbons.

The burner can be easily serviced, and can operate within a wide control range.

The openings formed in the deflection device are provided only for recirculation and, preferably, are so shaped or configured or arranged on the deflection device that no flames occur behind the deflection device, so that no flames which might smoke or cause carbon monoxide, unburned hydrocarbons or nitrogen oxides to form, will arise. The root or base of the flame formed by this burner, which is essentially ring-shaped, is stabilized inwardly by the deflection device and at the outside by the flame tube which, preferably and in accordance with a feature of the invention, terminates essentially in line with, or close to the outer end of the deflection device.

The reason for the high stability of the flame—in contrast to the patents using mixture distribution elements—is not completely clear. It appears, however, that the excellent gasification of the fuel before it is mixed with air results in a highly homogeneous mixture, which improves the overall flame. The precise geometric limiting of the cross section of the base of the flame also seems to contribute to the stability of the flame. There is no real mixing head which has narrow exit slits, resulting in a high exit speed of the air-fuel mixture. It is believed that the recirculation due to the recirculation openings of the deflection device itself prevent interfering turbulences behind the deflection device as such. An essentially laminar flow of hot gases to the recirculation openings apparently occurs back from the root of the flame.

It is an advantage of the burner in accordance with the present invention that the stability of the flame is increased, thus effectively avoiding formation of carbon monoxide in the exhaust gases. Complete combustion of all carbon components of the fuel, thus, further increases the efficiency and improves the reliability and safety of the overall heating system.

It is another advantage of the burner in accordance with the present invention that in many cases a specific or special gasifier and/or electrical heating need not be used. Electrical heating is desirable for cold-starting, however. The deflection device deflects the air-combustion gas mixture in essentially radial direction to the end of the flame tube. Consequently, the flame expands substantially in radial direction, which decreases the flame temperature. A decreased temperature reduces the formation of nitrogen oxides.

Deflecting the flame in radial direction is enhanced by suction which occurs due to the recirculation path formed by the flame tube at the root or start or base of the flame. The recirculation path is limited by the flame tube, and hot combustion gases are carried back to the combustion space, resulting in excellent gasifying of the fuel before it reaches the deflection device in gaseous form. It is of particular advantage that this recirculation is effectively independent of the dimensioning and shape of the combustion chamber or combustion space of a boiler with which the burner may be used.

It has been found, in operation, that the burner is low in operating noise, is easily serviced, and has a wide control or operating range, approximately of 40%, without requiring any special burner adjustments or mechanisms.

In accordance with a preferred feature of the invention, the deflection device is shaped roughly in form of a hollow cone or another concave body in which the apex or tip of the cone is directed towards the outlet of the gasifier. This particular shape results in a structure which is easy to make, while ensuring excellent condition of the resulting gas flow. Other shapes may be used, for example the gasifier, rather than being essentially conical, can be a dished or cup-shaped plate, in which the convex portion of the plate is directed towards the gasification chamber.

The openings in the deflection element can be in various forms; in accordance with a particularly suitable embodiment, the deflection element is formed in two sections. The recirculation opening than is ring-shaped, the two sections being axially spaced or staggered from each other. This arrangement results in a high stability of the flame. It is also equally possible to form a plurality of recirculation openings in the deflection element, for example by punching out openings from the inside, so that the punched material will project outwardly, similar to roof overhangs over the openings. This shape is particularly easy to manufacture and favors recirculation.

DRAWINGS

Figure 2:
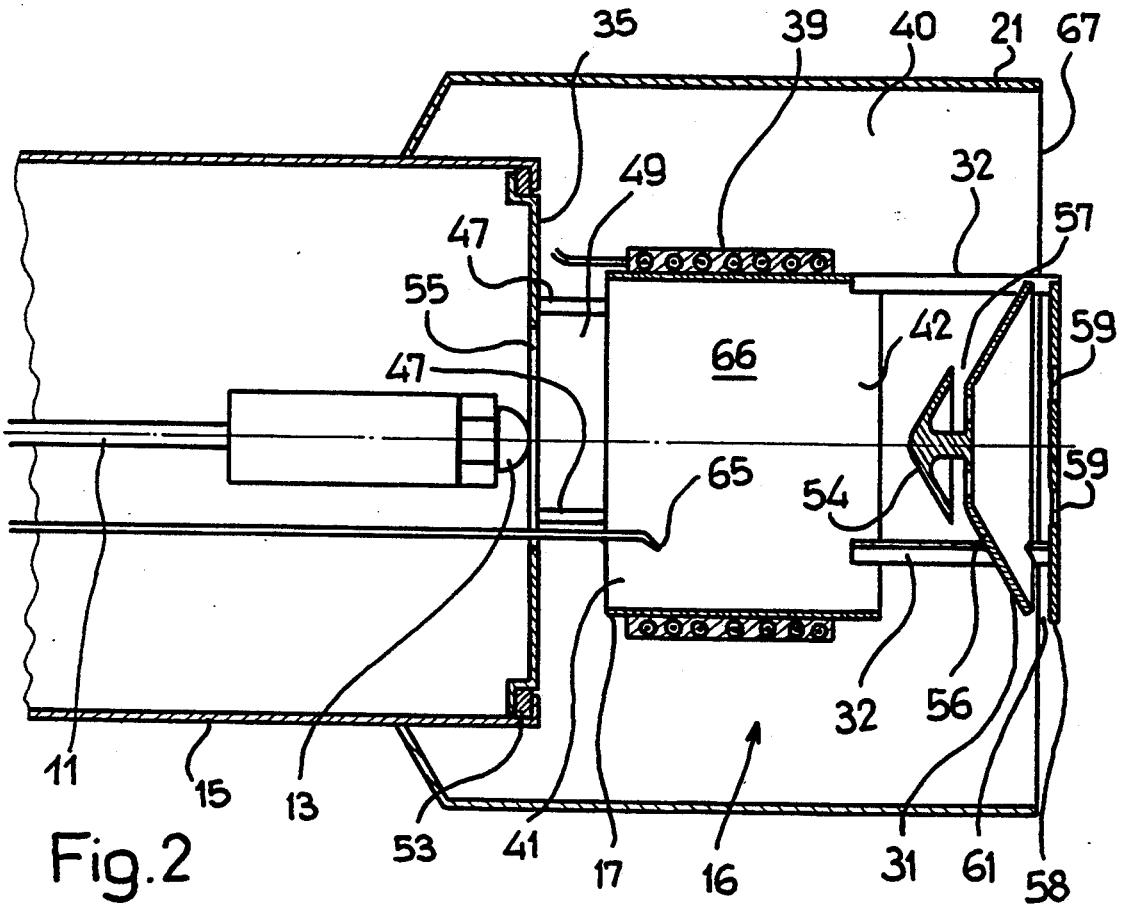
FIG. 2 is a schematic radial cross-sectional view through the burner head, illustrating, also, an atomizing nozzle.
Figure 6A:
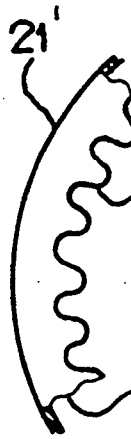
FIG. 6 is an end view of the burner head of FIG. 5.
Figure 9:
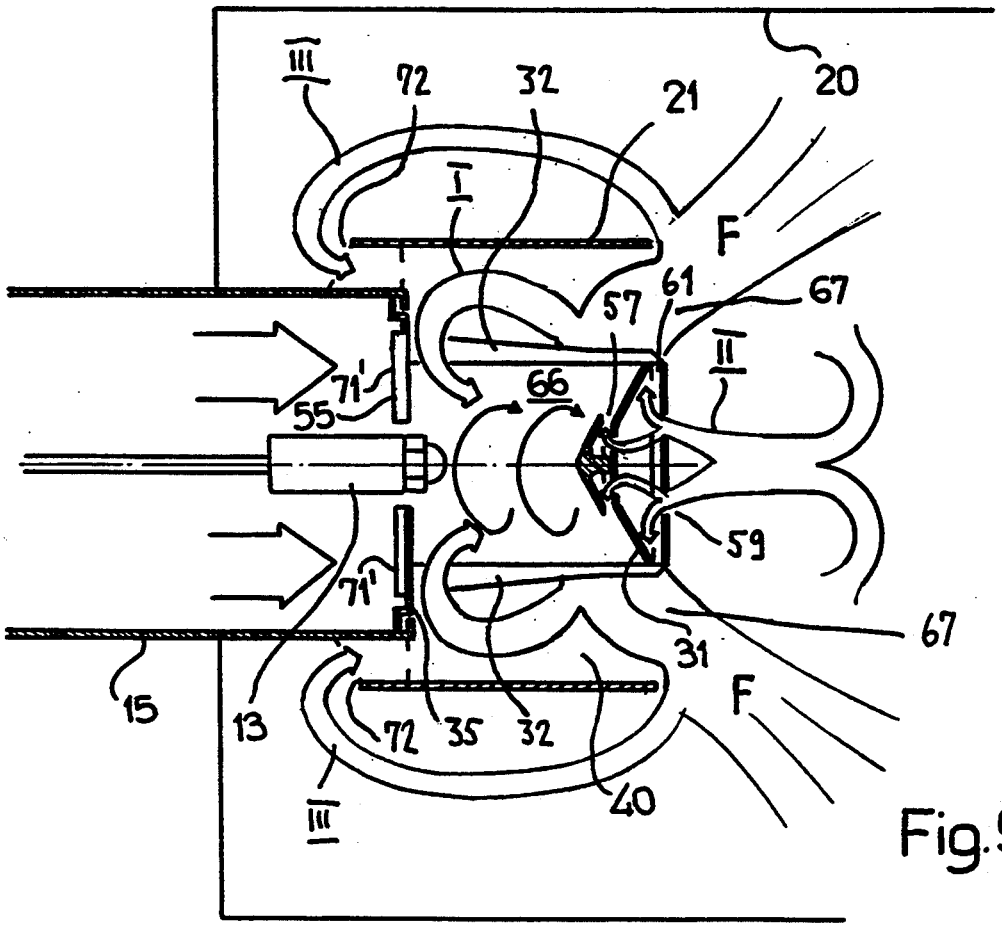
Figure 7:
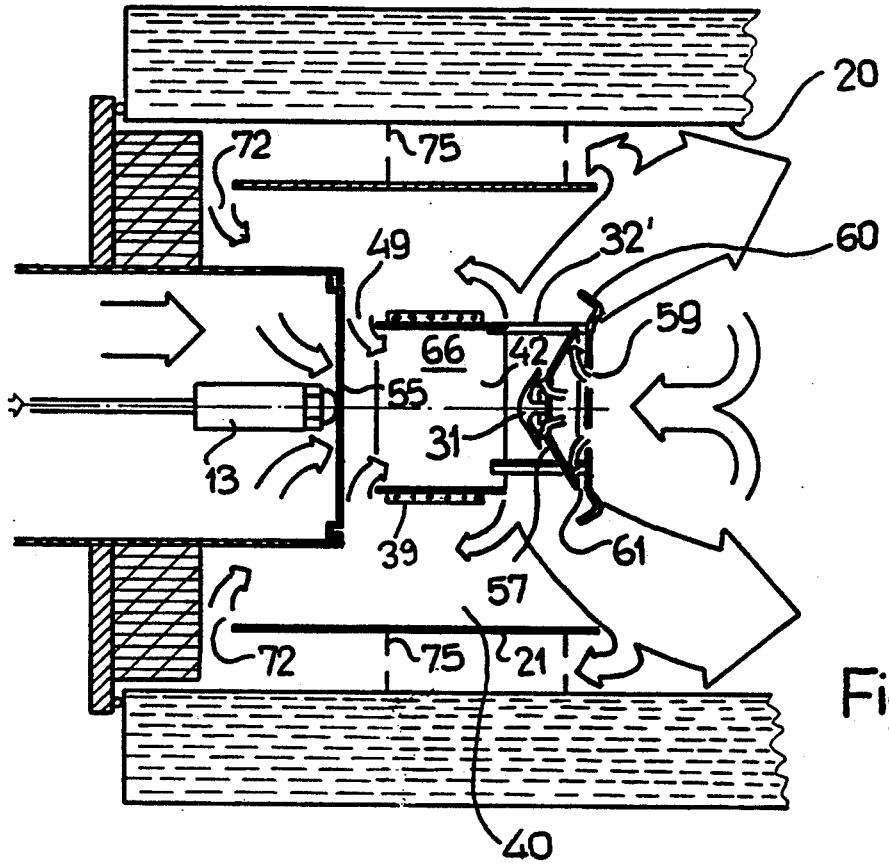
Figure 8:
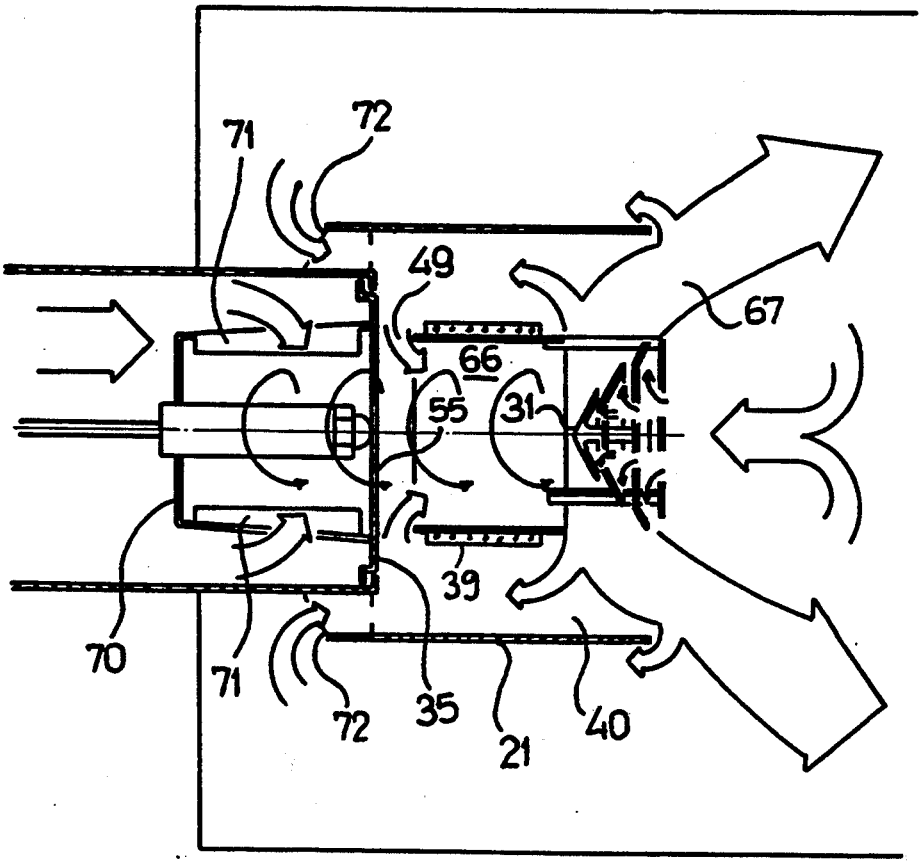

FIG. 6*a* is a fragmentary end view of another embodiment of the flame tube, with turbulence fingers;

FIG. 7 illustrates another embodiment of the invention in which the flame tube is formed by an element fitted in the furnace or combustion chamber of a boiler and providing an additional recirculation path;

FIG. 8 illustrates the burner of FIG. 7 in operation, and the flow paths, in which the air inlet is formed differently;

FIG. 9 illustrates yet another embodiment of the invention in which the gasification chamber is delimited by the flame tube and shows flow paths;

FIG. 10 is an end view of an air inlet orifice system with variable air flow;

FIG. 11 is a radial cross-sectional view of the orifice system of FIG. 10; and FIG. 12 illustrates an arrangement for selective use of the burner with either a liquid fuel such as oil, or gas, for example natural gas, and showing, for the burner head itself, the general structure of FIG. 2.

DETAILED DESCRIPTION

Figure 1:
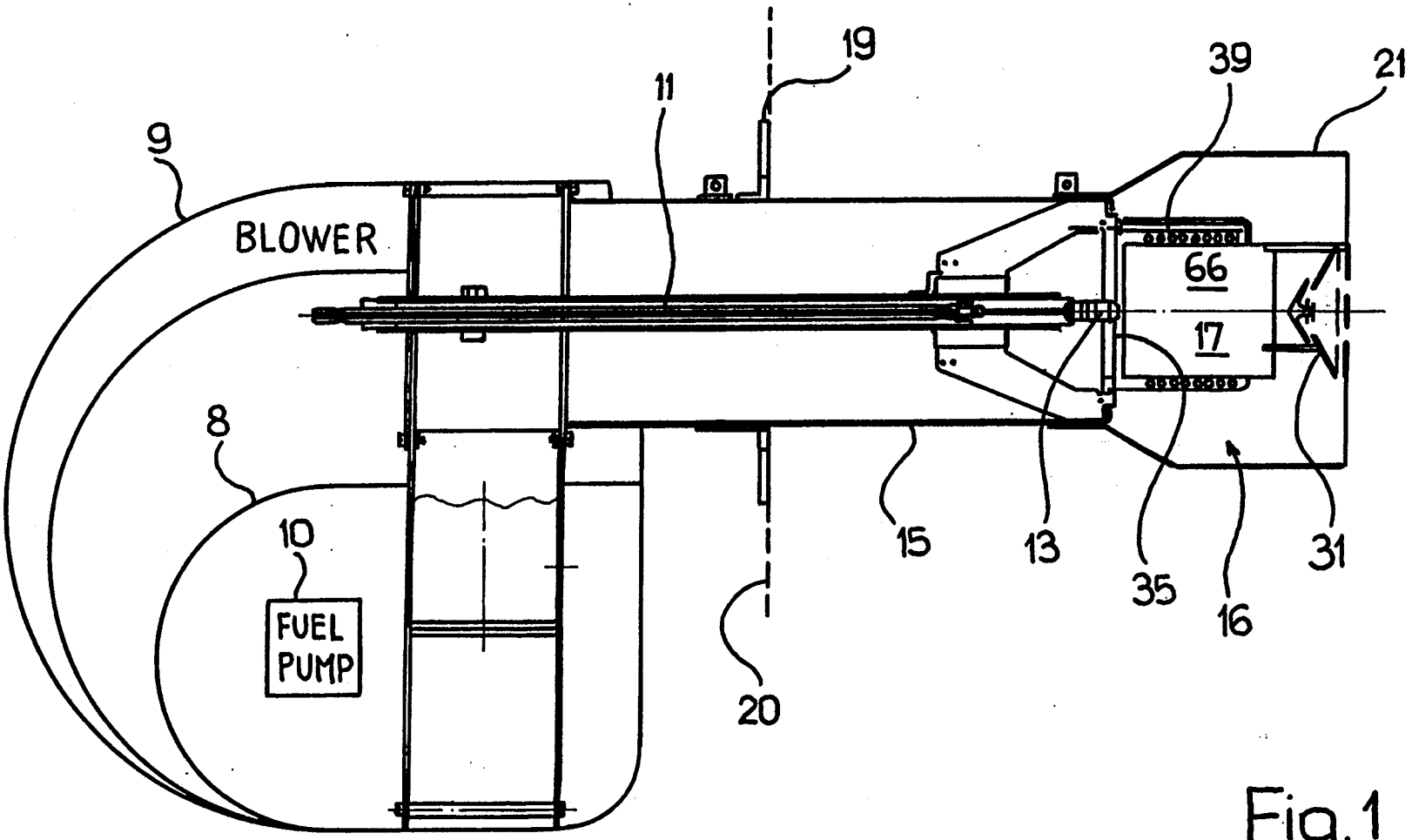
FIG. 1 is a highly schematic side view of the burner in accordance with the present invention in an entire burner system.

Referring first to FIG. 1:

The burner has a motor 8, which drives a fan or blower 9 and a fuel supply pump 10. Fuel is led through a fuel supply tube 11 to an atomizer nozzle 13. More than one atomizer nozzle 13 may be used, the nozzles being operative singly or in combination with each other. Air tube or air hose 15 supplies air to the burner head 16. The burner can be secured by a flange to a furnace chamber, for example of a boiler 20, shown in FIG. 1 only schematically.

FIG. 2 illustrates the burner head 16 in detail. The burner head 16, preferably, is a readily replaceable unit, secured, for example, to tube 15 in any suitable manner, not shown in FIG. 2. For example, the unit 16 can be coupled to the pipe or tube 15 by screws. A sealing ring 53 of heat-resistant material provides effectively air-tight coupling of the unit 16 with the pipe or tube 15.

The burner head 16, essentially, includes a gasifier 17, an air inlet diaphragm 35, an electrical heating unit 39 and, if required, additional elements, which will be described below. The unit 16 is surrounded by a flame tube 21.

The burner head 16, in accordance with a feature of the invention, further includes a deflection element 31. The flame tube 21 is relatively short and extends up to about only the remote end, with respect to the inlet diaphragm 35 of the deflection element 31. The space between the gasifier 17 and the flame tube 21 forms a recirculation path for hot combustion gases back to an inlet 41 of the gasifier 17.

The gasifier 17 is a round tubular element, secured, for example, by three legs 47 to the air inlet diaphragm 35, for example by spot-welding, rivets or the like. The space between the legs 47 forms recirculation openings. The attachment of the unit 16 to the tube 15, and the sealing ring 53, resulting in an effectively air-tight unit, ensures that the air necessary for combustion flows essentially only through an opening 55 in the air inlet diaphragm 35. The opening 55, preferably, is a central circular hole to supply air to a gasification space or region 66. The opening 55 is so dimensioned that the speed of air flowing therethrough provides for optimum operation of the burner. As best seen in FIGS. 10 and 11, the air flow can be controlled by forming additional smaller openings 50 surrounding the central opening 55. Preferably, a rotatable disk 36 with a central opening 55' and small openings 50' is located close to the diaphragm 35. A suitable handle or other control element—not shown in FIGS. 10 and 11 since it can be of any desired construction—provides for rotation of the disk 36, so that the throughput of air through the openings 50 can be unrestricted, throttled, or blocked.

The deflection element 31 is secured with legs, for example three legs 32, on the gasifier 17. In accordance with a feature of the invention, the deflection element 31 is approximately in the shape of an obtuse-angle hollow cone, the tip or apex of which is spaced from, and faces the outlet opening 42 of the gasifier 17, that is, it is positioned to face the gasification space 66. The deflection device could have different form, for example dished, cup-shaped, or part-spherical, for example essentially hemispherical. The deflection device, suitably, is formed in a plurality of sections 54, 56 located axially spaced from each other to define a ring-shaped recirculation opening 57. In the embodiment shown, a further section 58 is provided. Section 58 is in form of a plate with openings 59 therethrough, and spaced from the bottom of the cone formed by the second section 56 of the deflection element 31. The parts 56 and plate 58, being spaced from each other, form a further ring-shaped recirculation opening 61 leading into the interior of the hollow cone-shaped deflection element 31.

Figure 4:
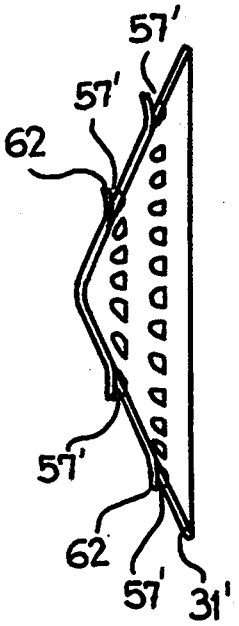
FIG. 4 is a fragmentary view illustrating another form of a deflection element.

Other shapes for the deflection element 31 may be used; FIG. 4, for example, illustrates another arrangement for deflection element 31'. The deflection element 31' is an essentially shallow conical sheet-metal element which has openings 62 punched out from the interior, to form slight gable or dormer-like projections, beneath which recirculation openings 57' are located. The construction of FIG. 4 can be manufactured particularly cheaply.

FIG. 2 additionally shows a conventional ignition electrode 65 which extends into the gasification space 66.

OPERATION, WITH REFERENCE TO FIG. 3

Upon starting, a start control circuit (not shown and well known in this field) energizes the electrical heating wiring 39. A usual starting period of about 2 minutes for a cold burner is sufficient. During this time, the gasification space 66 within the gasifier 16 is heated to a temperature of about 550° C. After the preheating time, the burner motor 8 is started to supply air under pressure charge by the ventilator or blower 9. Pump 10 for fuel supply also is driven. Oil pumped by the pump 10 is sprayed by the atomizing nozzle 13 into the gasification space 66, that is, within the gasifier 17. It can wet the walls of the gasifier 17. Due to the high temperature within the gasification space and of the gasifier, the oil immediately vaporizes and mixes with the air passing through the opening 55. The electrode 65, in the gasification space 66, provides for ignition. Placing the ignition electrode, and thus the ignition of the gas-air mixture, into the gasification space 66 has the advantage that a pressure pulse, arising upon ignition, is effectively avoided, so that the burner will start smoothly and softly. Ignition is rapid, since higher ignition temperatures are present at the beginning portions of the gasification space, where the electrode 65 is located (see FIG. 2), rather than adjacent the outlet. A blue flame will result in the ring-shaped gap 57 between the deflection device 31 and the flame tube 21. This flame is relatively short, however expands radially.

Figure 3:
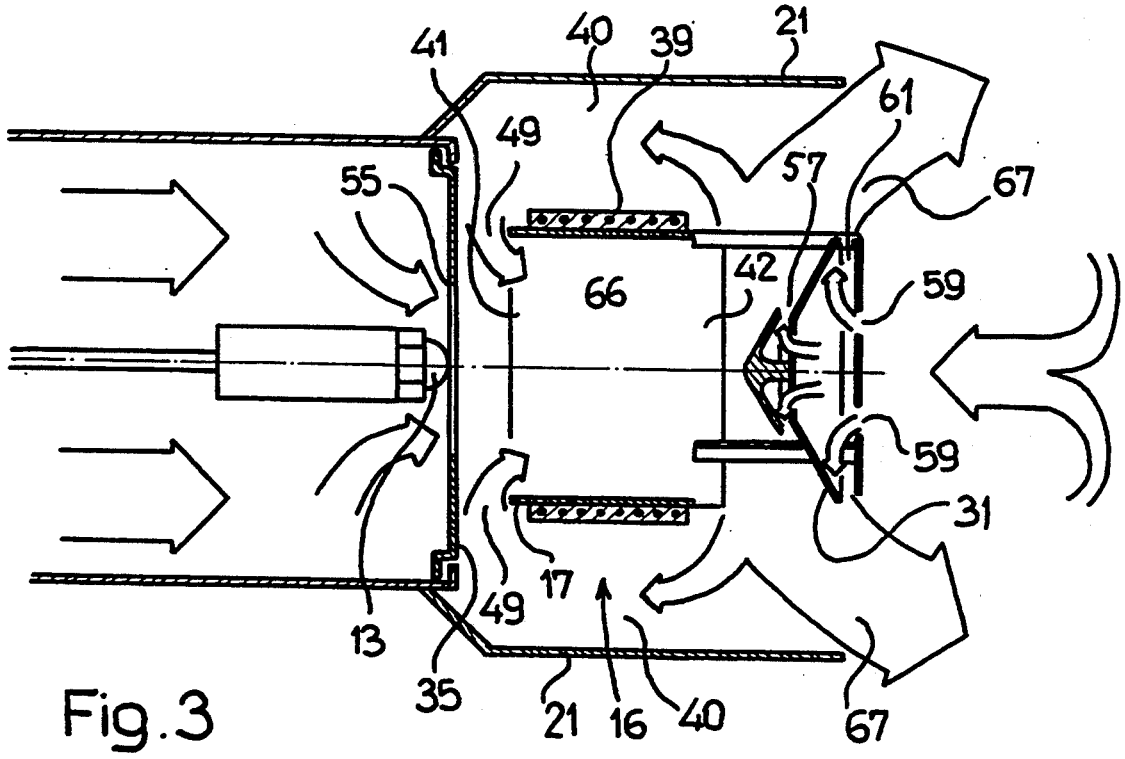
FIG. 3 is a view similar to FIG. 1 and showing gas and air flow, and recirculation paths, arising in operation of the burner of FIG. 2.

The arrows in FIG. 3 illustrate the flame as well as recirculation paths of hot combustion gases. A first recirculation path leads from the root or base of the flame at the outlet 67 through the ring-shaped space 40 between the gasifier 17 and the flame tube 21 to the recirculation inlet 49. The recirculation gases in this recirculation path heat the gasifier 17 and the electrical heater 39 can be de-energized after the burner has started. The hot gases flow from the inlet 41 of the gasification space back to the outlet 42 of the gasifier 17. These hot gases assist in gasification of fuel and mix with gasified fuel, as well as with incoming fresh air supplied through air tube 15. Thus, after a very short start and warm-up phase, practically all fuel drops vaporize within the vaporization space 66 without ever touching or wetting any structural components surrounding the vaporization space. The fresh air is supplied through the opening 55 into the center of the gasifier 17. Thus, excessive cooling of the gasifier structure 17, which might interfere with gasification, is effectively avoided.

In accordance with a feature of the invention, the ring-shaped outlet 67 between the deflection device 31 a second recirculation path is provided, which extends from and the flame tube 21 back into the interior of the deflection device 31 through the recirculation openings 59, 61, and 57, respectively, and back to the root or base of the flame at the gap 67. The hot gases in this second recirculation path heat the deflection device 31, thereby effectively eliminating coking of the deflection device 31, or the formation of any deposits thereon. Also, the formation of carbon monoxide is effectively prevented. It has been found that the formation of nitrogen oxygen compounds is decreased with respect to burners of the prior art. FIGS. 7 and 9 illustrate a further or third recirculation path. This recirculation path, if provided, extends around the outside of the flame tube 21 to the portion thereof adjacent the inlet region of the burner. The flame tube 21 is then formed with recirculation openings 72 (FIG. 7).

EMBODIMENT OF FIGS. 5 AND 6

The basic structure is the same, and the same reference numerals have been used throughout. Where there are any changes, prime notations have been used.

Figure 5:
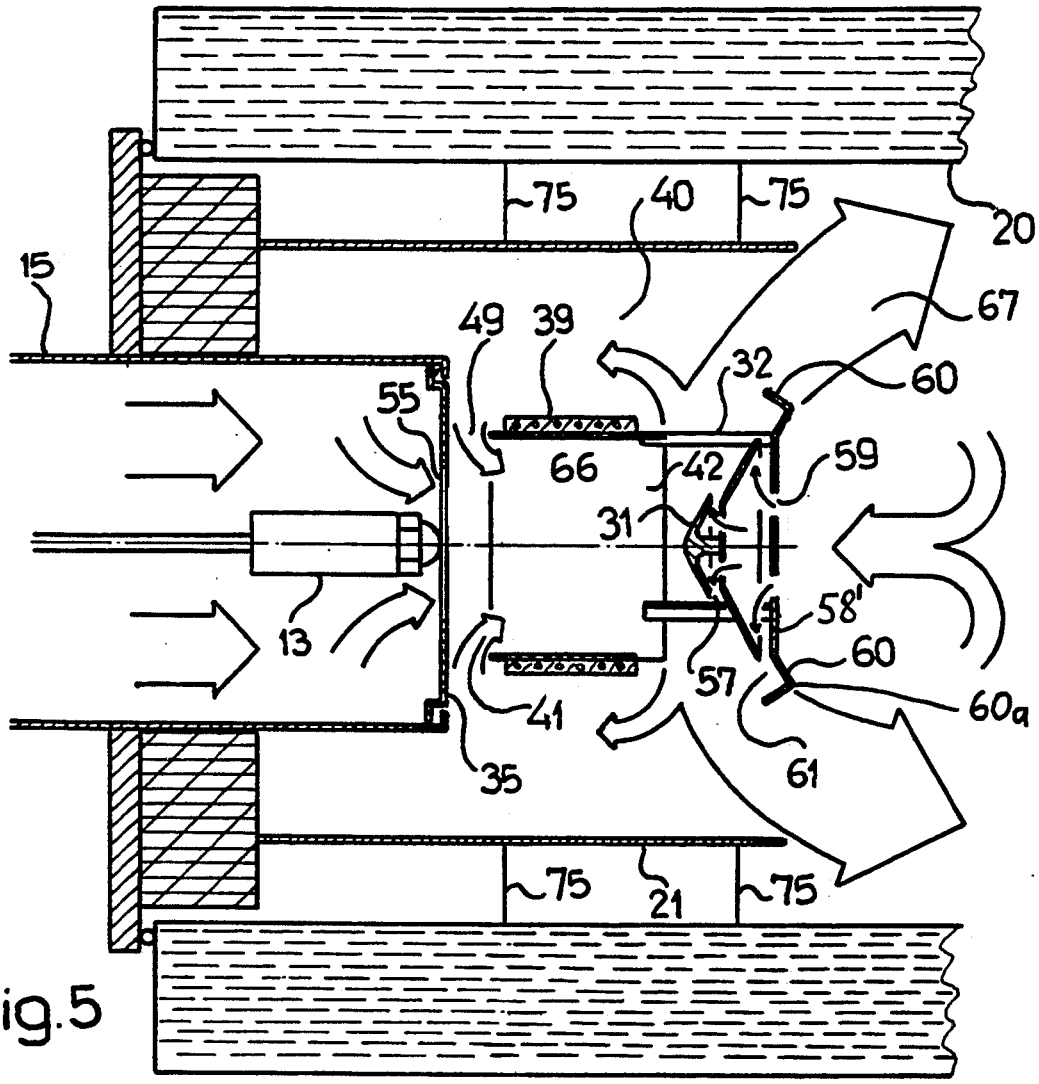
FIG. 5 shows another embodiment of the burner of the invention in which the flame tube is not part of the burner but inserted in a furnace.
Figure 6:
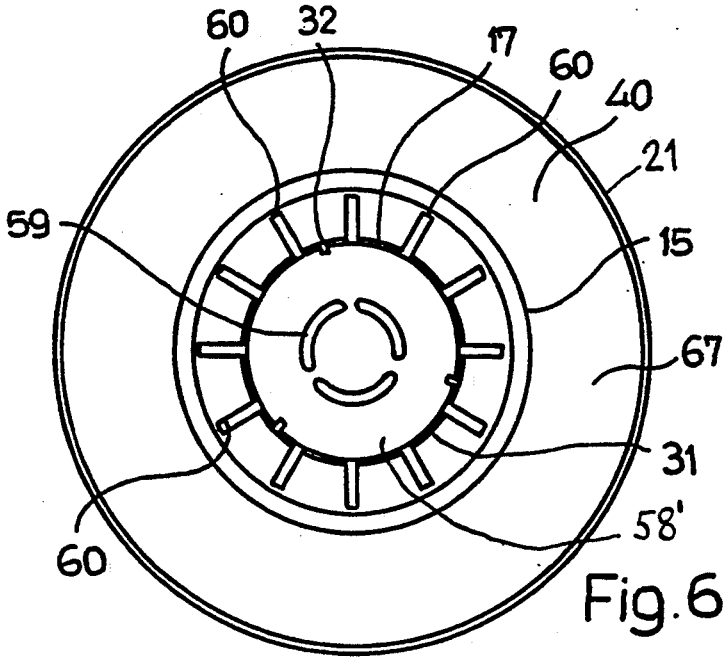

The plate 58' of the deflection element 31 is formed with a plurality of radially outwardly extending fingers 60. The fingers 60 are preferably bent in hook shape or of bowed or curved configuration, as seen in FIG. 5, forming an outwardly projecting apex 60*a*. The presence of the fingers 60 provides for particularly good stability of the flame and maintenance of its position in the burner. This arrangement is particularly suitable for burners having a power rating of over 20 to about 20,000 kilowatts. An additional improvement can be obtained by forming the flame tube 21, as illustrated in fragmentary end view representation in FIG. 6*a*, with inwardly extending fingers 64. Preferably, flame tube 21' is formed with a flange 66' at the end adjacent the remote end of the deflection element 31, formed in the embodiment of FIGS. 5 and 6 by the apeces 60*a* of the fingers 60 with the serrated flange 64. This additionally provides for stabilizing of the flame.

FIG. 5 illustrates, further, that the flame tube 21 need not be a component of the burner, but can be a separate element fitted into the combustion chamber. Thus, flame tube 21, or 21', respectively, can be secured to a burner portion of a furnace wall, shown only schematically at 20, for example by spacers or legs 75. In all other respects, the burner can be identical to that described in connection with FIG. 2. If a third gas recirculation path is desired, the flame tube 21 is formed with openings 72, as seen in FIG. 7. FIG. 7 also schematically shows the three recirculation paths, and air flow from the air supply tube 15.

In some installations it is desirable to supply the air from the air tube 15 in form of a rotating jet. FIG. 8 illustrates an air rotation system 70 having rotation vanes or wings 71. These wings guide the air into an essentially spiral circulating path, as illustrated by the rotation arrows in FIG. 8. This rotary circulation provides for particularly good gasification of fuel within the gasification space 66.

The gasifier structure 17 with the preheaters 39 is not strictly necessary; the invention is directed to forming a gasification space which need not necessarily be confined by a structural element, but can be formed by the interaction of the various gases being circulated and recirculated.

FIG. 9 illustrates a simplified embodiment of the burner of FIG. 2, omitting, however, the tubular gasifier 17 and the electrical heater 39. In accordance with the present invention, the deflection element 31, by impeding direct air flow through the diaphragm opening 55 directing the flame radially and providing for recirculation into the element 31, defines the gasification space 66. The deflection element 31 can be retained on the diaphragm plate 35. The deflection element 31 may, for example, have the structure of FIG. 2 or 4.

In this embodiment, it is preferred that the air admission diaphragm 35 is so constructed that an essentially spiral or helical air circulation will arise within the gasification space 66. The arrangement of FIG. 8 may be used or, alternatively, the diaphragm plate 35 is formed with radially outwardly extending wings or vanes 71' so that air which is fed into the gasification space 66 is subjected to a rotary component, as illustrated by the rotation arrows in FIG. 9. Air admission openings or diaphragms which provide for inflow of air in a rotating jet, by and themselves, are known.

OPERATION, WITH REFERENCE TO FIG. 9

Upon starting, the burner motor is started in order to provide the necessary combustion air. Oil supplied by the pump is sprayed into the gasification space 66. Ignition is effected by an ignition electrode—not shown in FIG. 9—and located, however, similarly to FIG. 2. A flame will form at the ring-shaped gap 67 between the deflection device 31 and the flame tube 21. This flame is relatively short in axial direction and expands radially. As soon as the flame is formed, the temperature in the gasification space becomes very high, and all fluid drops or droplets from the atomizing burner 13 will gasify before they can touch any structural components. Three features of this structure contribute to this operation:

(1) the braking, retarding or damming effect of the deflection device 31;

(2) recirculation of the hot gases; and (3) air turbulence or air eddies in the gasification space 66, particularly enhanced by the rotation imparted to the admitted air by the vanes 71'.

The three processes interact and mutually influence each other, so that the overall effect is highly complex. It is important that gasification of liquid fuel occurs in the gasification space 66 and that the flame emitted from the gap 67 is highly radially expanding. Thus, the flame will be a blue flame, resulting in very low $NO_x$ compounds, and practically devoid of any unburned hydrocarbons. The exhaust gases, therefore, are clean and contain a minimum of pollutants, substantially below any governmentally established limits.

The eddies in the supplied air and the recirculation paths are shown in FIG. 9, highly schematically, by the arrows therein. The first recirculation path I leads from the outlet 67 of the gasification space 66 along the inner wall of the flame tube 21 to the vicinity of the air diaphragm 35. The hot gases cause vaporization of the atomized fuel in the gasification space 66 and mix with the incoming air. The second recirculation path 2 leads from the ring-shaped gap 67 through the deflection device 31 into the gasification space 66. A third recirculation path III extends from outwardly of the flame tube 21 to opening 72 which, again, lead to the gasification space 66. In this embodiment, the openings 72 are desirable, since the third recirculation path enhances vaporization of atomized fuel within the gasification space 66.

The burner in accordance with the present invention can readily be constructed to be useful with alternate fuels, for example, selectively, with liquid and gaseous fuels. Such a burner is basically identical to any one of the burners described in connection with FIGS. 2–11. FIG. 12 illustrates the required modification. A gas supply pipe 77 is provided, supplying gaseous fuel in addition to the atomizing nozzle 13 for liquid fuel. The nozzle opening 79 of the pipe 77 is so selected and shaped that pressure of air supplied by the blower through the air tube 15 cannot affect the gas pressure. Such feedback effect would have negative influence with respect to the control characteristics of the burner. Thus, the outlet 79 of the gas supply 77 is spaced from the air diaphragm 55, preferably by a distance of between 5 to 20 millimeters. A gas diffuser 81 may be placed at the outlet 79 of the gas pipe 77.

Use of stabilizing fingers 60 (FIGS. 5, 6) results in a particularly stable flame. Use of the serrated flange 66' (FIG. 6*a*) on the flame tube additionally provides for stabilization of the flame.

The opening 55 in the air diagram 35 is preferably circular and axially aligned with the atomizer nozzle 13 and/or the gas supply tube 77 and the diffuser 81 at the end thereof. The air diaphragm, or a structure upstream thereof, can be so constructed that the air, which is supplied by the blower or fan, is given a spiral twist. This results in eddies which ensure effective intermixture of air, hot vases and fuel, which, in turn, enhances gasification of liquid fuel.

If a structural gasifier is used, the electric heater 39 is preferably provided, which results in particularly rapid starting. The gasifier tube is then heated before fuel is supplied. This arrangement avoids the formation of unburned hydrocarbons in the exhaust gases from the burner when it is first started. It has been found, however, that ignition will result even without prior preheating and that the gasification space, and/or the gasifier are rapidly heated by the recirculation interiorly of the flame tube and, preferably, also exteriorly thereof. The recirculation, due to the particular form of the deflection element, also heats the deflection element itself so that the danger of deposits of liquid fuel on the deflection element, which might burn on or coke, is effectively avoided, even if there is no pre-heating by an electrical heater before the burner receives atomized fuel from the nozzle 13.

Preferably, the deflection device, the air diaphragm, the gasifier and the electrical heater, if present, form a single structural unit. Such a unit can be easily replaced if service of the burner is required. The flame tube 21, selectively, can also form part of the unit and, preferably, is arranged coaxially with respect to the gasification space. This results in a particularly compact and easily replaced construction, in which, further, the recirculated hot combustion gases provide for uniform heating of the gasifier and/or the gasification space.

The air diaphragm 35 is preferably positioned with some space with respect to the gasifier 17, to form a gap between the diaphragm 35 and the gasifier 17, which is a recirculation gas inlet. Thus, recirculated hot gases pass essentially along the inner wall of the gasifier; cold air supplied under pressure by the blower will be in the central region of the gasifier. The ignition electrode is preferably placed close to the outer edge of the gasification space, that is, close to the gasifier 17 if provided. Causing the cold air to flow more in the interior of the gasification space results in good vaporization of liquid fuel and avoids vaporization of residual liquid fuel after the burner is shut off. When the burner is shut off, the gasifier or the region around the gasification space is still so hot that any remanent fuel will vaporize and any still supplied air will cause burning of the so vaporized remainder. Relatively cold air will not even cool the deflection element 31, although it may flow in the center of the gasification space. The recirculation of hot gases through the recirculation openings in the deflection element causes sufficient heating thereof and thereby eliminates any problems with respect to burned-on deposits or coking.

The ignition electrode is preferably located within the gasification space 66, or close to the inlet of the gasifier 17. This results in soft or gradual ignition and ignition pulses are effectively avoided.

FIG. 9 also, highly schematically, shows the recirculation paths I from the flame F inside the flame tube 21 back into the gasification space 66; the second recirculation path II into the interior of the deflection element 31, and out from the openings of the deflection element towards the root of the flame and through opening 57 into the gasification space; and, the optional third recirculation path III through an opening 72 in the flame tube 21. The recirculation path II occurs due to the suction resulting from the formation of the flame as the charged air is applied through tube 15 into the gasification space 66, the flame extending, not in axial but flaring outwardly in radial direction due to the arrangement of the end portion of the flame tube 21 with respect to the end plate 58, or the end 60*a*, respectively, of the deflection element, and the internal shape of the deflection element, in the form of a shallow cone or part-sphere to deflect the flame F, as shown schematically.

Various changes and modifications may be made, and features described in connection with any one of the embodiments may be used with any of the others, within the scope of the inventive concept.

We claim:

1. Clean burning burner for gasifying and combusting liquid fuel, said burner having a burner body (15);

fuel supply means (11, 13; 77, 79) providing atomized fuel under pressure;

an air blower (9) providing a blown air stream;

means for defining a gasification space (66) for effectively complete gasification of the atomized fuel and said blown air supplied by said fuel supply means and said air blower, respectively;

a gasification space air inlet means (35) formed with a gasification space air inlet opening (55), coupled to the burner body;

a stream deflection element (31) located spaced from the means defining a gasification space and positioned to provide for mixing of the atomized fuel with the blown air, said stream deflection element having a remote end (58, 60*a*), remote from said gasification space air inlet opening (55);

a flame tube (21) outside of, and surrounding the gasification space (66) extending longitudinally from a region in the vicinity of the gasification space air inlet opening (55) approximately up to the remote end (58, 60*a*) of the stream deflection element (31);

said stream deflection element (31) being, at least in part hollow cup-shaped perforated member, and a perforated plate extending over and spaced from said cup-shaped member to form a recirculation zone therebetween, and being shaped, configured and said stream deflecting element being positioned with respect to the flame tube (21) to form an essentially ring-shaped outlet space (40) between the deflection element (31) and the flame tube (21) where the root or base of the flame of the burner will form upon mixing and combustion of the gasified fuel-air mixture in said gasification space, said flame extending in essentially radial direction to the end of the flame tube;

means forming a first recirculation path (I) for recirculation of hot combustion gases back into said gasification space (66) formed by said stream deflection element (31), in combustion with said flame tube (21), and located between said means forming said gasification space and said flame tube, said stream deflection element (31) deflecting hot combustion gases into said first recirculation path; and wherein the stream deflection element (31) and perforated plate are formed with a plurality of openings (57, 61, 59; 57'), which openings are positioned for conducting hot combustion gases from said recirculation zone through said stream deflection element and plate and into said first recirculation path (66) in a second recirculation path (II), while heating said stream deflection element.

2. The burner of claim 1, wherein the deflection element (31) is generally shaped in the form of a hollow structure having a projecting portion element, optionally a hollow cone having an obtuse cone angle or part-sphere, the apex of which is directed towards the gasification space (66).

3. The burner of claim 1, wherein said stream deflection element (31) comprises a hollow convex structure, optionally conical or part-spherical, located such that the apex thereof faces the gasification space (66), and wherein the openings in said structure provide for an essentially axially and then radially extending recirculation path through the concave inner portion of said hollow structure.

4. The burner of claim 1, wherein said stream deflection element (31) comprises a plurality of parts (54, 56, 58) axially spaced from each other, the spacing of said parts forming said openings (57, 61) in the stream deflection element (31).

5. The burner of claim 1, wherein said stream deflection element (31) is formed with a plurality or recirculation openings located circumferentially thereon, and at least one opening (59) at the remote end to permit hot gases to enter into the interior of said stream deflection element (31) in at least approximately axial flow direction.

6. The burner of claim 5, wherein said recirculation element (31) comprises a shallow cup, dished, optionally conical or part-spherical element having a wall portion, said wall portion being formed with said plurality of openings (57'), the outer ends of which form deflecting projections (62) in gable or dormer form for directing the mixture of gases and fuel past said openings and inducing suction of recirculation gases axially into and out of said openings.

7. The burner of claim 1, wherein said air inlet (35) includes means (71) for imparting a rotary component to air admitted therethrough, whereby the air passing into said gasification space (66) will have an approximately spiral air distribution shape.

8. The burner of claim 7, including a plurality of vanes (71, 71') located upstream of the air inlet opening (55) to form said means to impart a rotary component to the air admitted by the inlet means.

9. The burner of claim 1, further including a plurality of radially extending, outwardly bent fingers (60) extending from the circumference of the stream deflection element (31), the outermost bend of said fingers defining said remote end of the stream deflection element (31).

10. The burner of claim 1, including a plurality of radially inwardly extending fingers (64) located on the flame tube and at the end which is approximately up to said remote end (58, 16*a*) of the stream deflection element (31).

11. The burner of claim 1, wherein the flame tube (21) is formed by a tubular element fitted into a furnace (20) adapted to receive said burner.

12. The burner of claim 1, wherein said air inlet means (35) comprises an air inlet diaphragm (35) formed with said air inlet opening (55), optionally a centrally located circular opening, and axially aligned with said gasification space (66).

13. The burner of claim 12, further including a plurality of openings (50) small with respect to said centrally located opening (55) and positioned to surround said centrally located opening.

14. The burner of claim 13, further including a rotatable disk formed with openings (50') and rotatable for selectively covering or uncovering the smaller openings 50 in said diaphragm to control the amount of air passing into the gasification space (66).

15. The burner of claim 1, wherein said means forming said gasification space includes an essentially tubular structure having an inlet (41) and an outlet (42) and surrounding, at least in part, said gasification space (66), positioned optionally coaxially with respect to the air inlet opening (55) and further positioned coaxially with respect to said stream deflection element (31).

16. The burner of claim 15, further including an electrical heating element (39) positioned in heat transfer relationship with respect to said tubular structure of the gasifier (17).

17. The burner of claim 1, wherein said air inlet means (35) comprises an air inlet diaphragm (35) formed with said air inlet opening (55); and wherein said air inlet diaphragm (35) and said stream deflection element (31) from a single structural unit.

18. The burner of claim 15, including an air inlet diaphragm (35) formed with an opening (55) therein, and forming said air inlet means; and wherein said air inlet diaphragm (35), said stream deflection element (31), said gasifier (17) and, optionally, an electric heater (39) coupled to said gasifier, form a single structural unit (16).

19. The burner of claim 15, wherein said gasifier (17) and said fuel supply means are located coaxially with respect to the flame tube (21).

20. The burner of claim 15, wherein said air inlet means (35) comprises an air supply diaphragm (35) formed with said air inlet opening (55) therein wherein said diaphragm (35) is axially spaced from the means forming said gasification space to define an essentially ring-shaped gap (49) between said diaphragm and said means forming said gasification space, said ring-shaped gap forming a gas recirculation inlet (49) into the gasification space (66) said gasifier.

21. The burner of claim 1, further including an ignition electrode (45) located in said gasification space (66).

22. The burner of claim 1, wherein said fuel supply means comprises an atomizing nozzle (13) for liquid fuel and a gas supply tube (77) optionally terminating in a diffuser (81) for gaseous fuel.

23. The burner of claim 22, wherein said air inlet means (35) comprises an air inlet diaphragm (35) formed with said air inlet opening (55), said opening being coupled to said blower via said burner body which includes an air supply tube (15) for supplying air under positive pressure; and wherein the diffuser (81), of the gas supply tube (77) is spaced from said air inlet opening (55) in the diaphragm (35) by a space sufficient to prevent back-pressure of the supplied air from affecting the gas pressure in the gas supply.

24. The burner of claim including means about said flame tube forming a third recirculation path to said gasification space.

25. The burner of claim 1, wherein a portion of the flame tube (21) is located spaced from said gasification space (66) and forms a gap therewith;

the air supply means includes an air inlet diaphragm (35) formed with said air inlet opening (55), said opening being coupled to said blower via said burner body including an air supply tube (15) for supplying air under positive pressure and said flame tube (21) extends, in part, over the outside of said air supply tube (15) rearwardly said flame tube being spaced from the outside of said air supply tube (15) by a gap, and means providing a third recirculation path (III) for hot gases from the outside of said flame tube (21) to the inside thereof and then into said gasification space (66).

* * * * *